US010311785B2

(12) United States Patent
Cronin et al.

(10) Patent No.: US 10,311,785 B2
(45) Date of Patent: Jun. 4, 2019

(54) RELATING TO DRIVERS

(71) Applicant: BAE SYSTEMS plc, London (GB)

(72) Inventors: Thomas Oliver Cronin, Rochester (GB); Gary Paul Chambers, Rochester (GB)

(73) Assignee: BAE SYSTEMS plc, London (GB)

( * ) Notice: Subject to any disclaimer, the term of this patent is extended or adjusted under 35 U.S.C. 154(b) by 0 days.

(21) Appl. No.: 15/548,995

(22) PCT Filed: Feb. 4, 2016

(86) PCT No.: PCT/GB2016/050258

§ 371 (c)(1),
(2) Date: Aug. 4, 2017

(87) PCT Pub. No.: WO2016/128716

PCT Pub. Date: Aug. 18, 2016

(65) Prior Publication Data

US 2018/0040276 A1 Feb. 8, 2018

(30) Foreign Application Priority Data

Feb. 12, 2015 (GB) ..... 1502324.5

(51) Int. Cl.
*G09G 3/36* (2006.01)
*G09G 3/3233* (2016.01)
(Continued)

(52) U.S. Cl.
CPC ..... *G09G 3/3233* (2013.01); *G09G 3/3406* (2013.01); *G09G 3/3696* (2013.01); *H05B 33/0803* (2013.01)

(58) Field of Classification Search
CPC ..... G09G 3/36
See application file for complete search history.

(56) References Cited

U.S. PATENT DOCUMENTS 6,310,589 B1 10/2001 Nishigaki et al.
6,914,388 B2 * 7/2005 Shin ..... G09G 3/3216 315/169.2

(Continued)

FOREIGN PATENT DOCUMENTS

JP 2002366099 A 12/2002
JP 2003031358 A 1/2003

(Continued)

OTHER PUBLICATIONS

International Search Report and Written Opinion received for Patent Application No. PCT/GB2016/050258, dated Apr. 29, 2016. 12 pages.

(Continued)

*Primary Examiner* — Olga V Merkoulova
(74) *Attorney, Agent, or Firm* — Finch & Maloney PLLC

(57) ABSTRACT

A driver circuit for an LED display for switching a light-emitting diode (LED) between a non-luminous state and a luminous state for producing light for a display, the driver circuit comprising an LED, a drive current controller (10) arranged to selectively open and close a drive current flow path (8) through the LED (2) thereby selectively to switch the LED between a non-luminous state and a luminous state, a charge injector unit (13) for inputting charge into the LED to store said charge within the LED via the junction capacitance (3) thereof, a control unit (12) arranged to control the charge injector unit to input said charge into the LED concurrently with the opening of the drive current flow path.

21 Claims, 4 Drawing Sheets

(51) Int. Cl.
*H05B 33/08* (2006.01)
*G09G 3/34* (2006.01)

(56) References Cited

U.S. PATENT DOCUMENTS

| | | | | |
|---|---|---|---|---|
| 2001/0048410 | A1 | 12/2001 | Nishigaki et al. | |
| 2003/0169241 | A1* | 9/2003 | LeChevalier | G09G 3/3216 345/204 |
| 2003/0184237 | A1 | 10/2003 | Togashi et al. | |
| 2005/0110722 | A1* | 5/2005 | Hayafuji | G09G 3/3216 345/76 |
| 2006/0202921 | A1* | 9/2006 | Suzuki | G09G 3/3216 345/76 |
| 2007/0120778 | A1* | 5/2007 | Kimura | G09G 3/3216 345/76 |
| 2014/0139603 | A1 | 5/2014 | Fujita et al. | |
| 2014/0139605 | A1* | 5/2014 | Fujita | G03G 15/04054 347/118 |

FOREIGN PATENT DOCUMENTS

| | | | |
|---|---|---|---|
| WO | 2015001363 | A1 | 1/2015 |
| WO | 2016128716 | A1 | 8/2016 |

OTHER PUBLICATIONS

GB Intellectual Property Office Search Report under Section 17(5) received for GB Patent Application No. 1502324.5 dated Aug. 4, 2015. 4 pages.

International Preliminary Report on Patentability received for Patent Application No. PCT/GB2016/050258, dated Aug. 24, 2017. 9 pages.

* cited by examiner

RELATING TO DRIVERS

FIELD OF THE INVENTION

The present invention relates to drivers for light-emitting semiconductor devices, such as light-emitting diodes (LED). In particular, though not exclusively, the invention relates to drivers for LEDs in a display system, such as a display panel or projector.

BACKGROUND

Colour-sequential illumination of display panels and projectors may use LEDs as the source of image-bearing light. Images are formed using short pulses of patterned light from a selected pattern of LEDs within an array of LEDs in a display panel. In order to display a colour image, the array of LEDs must be controlled to generate the desired pattern repeatedly in a rapid sequence of short pulses. This permits the display panel to display the desired pattern in each one of three colour component values (e.g. Red, Green and blue). The effect of the sequential display, visually speaking, is to display the desired pattern in full colour. Of course, the desired pattern may be a still image or may correspond to one frame of a moving image.

In order to achieve a high-quality image, the light output from the LEDs should ideally be uniform over time when the LED is in the "on" state. The LEDs should ideally be well synchronised with the switching of the display panel such that each LED changes between the "on" and "off" states rapidly, without significant delay.

Achieving these desirable properties is made problematic by the inherent junction capacitance of an LED which becomes a significant parasitic current sink when an LED is driven at low luminance levels and, therefore at low current levels. The effect is to cause the luminance output of the LED to become skewed in time during the operation of the LED. In particular, ideally, the luminance profile of a pulse of light output by an LED in a sequential display, should be substantially square as shown in FIG. 1. This is difficult to achieve in practice due to the junction capacitance of the LED, which can be modelled as an ideal diode and a parasitic capacitor connected in parallel across the ideal diode, as is shown schematically in FIG. 2.

When a square pulse of current is input to the LED, the parasitic capacitor takes some of the input current during the initial turn-on of the input current pulse and begins to charge itself. This takes current away from the light-emitting processes within the LED which rely on current flow and, in doing so, the rate of increase in light output from the LED is reduced. In particular a sharp/rapid rise in luminous output is suppressed by the diversion of current to the charging parasitic capacitor. Conversely, when the driving current pulse ends, and the input current falls to zero, the parasitic capacitor begins to discharge and thereby maintains a current—albeit a falling current—through the LED. This discharge current maintains a luminous output from the LED when none is desired. The result is that a sharp/rapid fall in luminous output is suppressed by the supply of current from the discharging parasitic capacitor. A schematic example of this is illustrated in the current and luminosity timing diagrams of FIG. 3.

For example, parasitic junction capacitance in LEDs may be of the order of nanoFarrads (e.g. C=4 nFs). The threshold voltage for a high-power LED may be of the order of a few volts (e.g. V=3 volts). If such an LED is driven with a current of I=1 mA, from an initial voltage potential of zero volts in the "off" state, then the time (t) required to reach the 3V threshold voltage would be (t=CV/I) about 12 micro-seconds. This is unacceptable in display systems requiring luminance settling times of about 1 micro-second.

The invention aims to provide an improved driver for an LED for use in a display system.

SUMMARY OF THE INVENTION

In a first of its aspects, the invention may provide a driver circuit for an LED display for switching a light-emitting diode (LED) between a non-luminous state and a luminous state for producing light for a display, the driver circuit comprising: an LED; a drive current controller arranged to selectively open and close a drive current flow path through the LED thereby selectively to switch the LED between a non-luminous state and a luminous state; a charge injector unit for inputting charge into the LED to store said charge within the LED via the junction capacitance thereof; a control unit arranged to control the charge injector unit to input said charge into the LED concurrently with the opening of the drive current flow path.

The drive current controller is preferably arranged to selectively electrically connect and disconnect the cathode or anode of the LED to a drive voltage source to reversibly form the current flow path. The cathode and anode may be selectively connected to different electrical potentials.

The charge injector unit may be electrically connected to the cathode of the LED.

The charge injector unit may be arranged to cause an electrical current of predetermined size to flow to the LED for an interval of time of predetermined duration thereby to input into the LED a predetermined quantity of electrical charge according to the product of said size and said duration.

The duration is preferably less than 1 (one) micro-second, or more preferably less than 900 ns, or yet more preferably less than 800 ns, or even more preferably less than 700 ns, or yet even more preferably less than 600 ns, such as about 500 ns or less.

The charge injector unit may be arranged to input into the LED a predetermined quantity of electrical charge according to the value determined by the product of the value of the forward threshold voltage of the LED and the value of the junction capacitance thereof. More generally, when the LED has a non-zero sub-threshold voltage across it, then the quantity of charge to be injected may be determined according to the product of the value of: the difference between the forward threshold voltage of the LED and the sub-threshold voltage and the value of its junction capacitance. Preferably, controller may be arranged to implement or control the following steps in calculating the value of the junction capacitance (C) of the LED in order to calculate the appropriate value of charge to inject therein, as follows:

(1) Discharge any existing stored charge in the junction capacitance (C) of the LED;
(2) Draw a substantially constant current (I) from the LED to begin re-charging the junction capacitance;
(3) Determine the change (dV) of the voltage across the LED occurring in a given time interval (dt) as the junction capacitance re-charges;
(4) Determine the value of the junction capacitance as: C=I(dt/dV).

The control unit may be arranged to determine (e.g. calculate) a time interval defined as: $\Delta t = C(V_{Th} - V_{pc})/I_{Inject}$. Here, $V_{Th}$ is the forward threshold voltage of the LED and $V_{pc}$ is any pre-existing ('pre-charge') voltage across the LED which may be pre-set to a non-zero, sub-threshold value. The control unit may preferably be arranged to determine (e.g. calculate) time interval Δt and to issue a control signal to the charge injector unit to implement the charge injection accordingly. Thus, the control unit may control the charge injector unit to inject into the LED a substantially fixed current ($I_{Inject}$) over a period equal to the time interval so as to re-charge the junction capacitance of the LED.

The driver circuit may comprise a transistor electrically connected in series to the LED upon said current flow path, wherein the drive current controller is arranged to control the conductivity of the transistor to open and close the drive current flow path selectively.

The drive current controller may be arranged to control the conductivity of the transistor to maintain a substantially constant drive current in the drive current flow path when open.

The driver circuit may include a current monitor unit arranged to monitor the value of electrical current flowing along the drive current flow path and to output to the drive current controller a current monitor signal indicative thereof, wherein the drive current controller is responsive to the current monitor signal to control the conductivity of the transistor so as to maintain said substantially constant drive current.

The driver circuit may include a voltage control unit arranged to apply a predetermined sub-threshold forward voltage to the LED which is less than the threshold voltage of the LED, wherein the control unit is arranged to control the voltage control unit to apply said sub-threshold forward voltage to the LED concurrently with the closing of the drive current flow path.

The invention, in a second aspect, may provide a display comprising a driver circuit as described above.

In a third aspect, the invention may provide a method for driving a light-emitting diode (LED) to switch between a non-luminous state and a luminous state for producing light for a display, the method comprising: providing an LED; selectively opening and closing a drive current flow path through the LED thereby selectively switching the LED between a non-luminous state and a luminous state; inputting charge into the LED to store said charge within the LED via the junction capacitance thereof; controlling the charge injector unit to input said charge into the LED concurrently with the opening of the drive current flow path.

The method may include selectively electrically connecting and disconnecting the cathode or anode of the LED to a drive voltage source to reversibly form the current flow path. The cathode and the anode may be selectively connected to different respective electrical potentials.

The charge may be input to the cathode of the LED.

The method may include causing an electrical current of predetermined size to flow to the LED for an interval of time of predetermined duration thereby to input into the LED a predetermined quantity of electrical charge according to the product of said size and said duration.

The duration is preferably less than 1 (one) micro-second.

The method may include inputting into the LED a predetermined quantity of electrical charge according to the value of the product of the value of the forward threshold voltage of the LED and the value of the junction capacitance thereof. More generally, when the LED has a non-zero sub-threshold voltage across it, then the method may include determining the quantity of charge to be injected according to the product of the value of: the difference between the forward threshold voltage of the LED and the sub-threshold voltage and the value of its junction capacitance. The method may include calculating the value of the junction capacitance (C) of the LED in order to calculate the appropriate value of charge to inject therein, as follows:

(1) Discharging any existing stored charge in the junction capacitance (C) of the LED;

(2) Drawing a substantially constant current (I) from the LED to begin re-charging the junction capacitance;

(3) Determining the change (dV) of the voltage across the LED occurring in a given time interval (dt) as the junction capacitance re-charges;

(4) Determining the value of the junction capacitance as: C=I(dt/dV).

The method may include determining a time interval defined as: $\Delta t=C(V_{Th}=V_{pc})/I_{Inject}$. Here, $V_{Th}$ is the forward threshold voltage of the LED and $V_{pc}$ is any pre-existing ('pre-charge') voltage across the LED which may be pre-set to a non-zero, sub-threshold value. The method may include injecting into the LED a substantially fixed current ($I_{Inject}$) over a period equal to the time interval so as to re-charge the junction capacitance of the LED.

The method may include providing a transistor electrically connected in series to the LED upon said current flow path, wherein the method includes controlling the conductivity of the transistor to open and close the drive current flow path selectively.

The method may include controlling the conductivity of the transistor to maintain a substantially constant drive current in the drive current flow path when open.

The method may include monitoring the value of electrical current flowing along the drive current flow path and controlling the conductivity of the transistor so as to maintain said substantially constant drive current.

The method may include applying a predetermined sub-threshold forward voltage to the LED which is less than the threshold voltage thereof, and applying said sub-threshold forward voltage to the LED concurrently with the closing of the drive current flow path.

DETAILED DESCRIPTION

Figure 1:
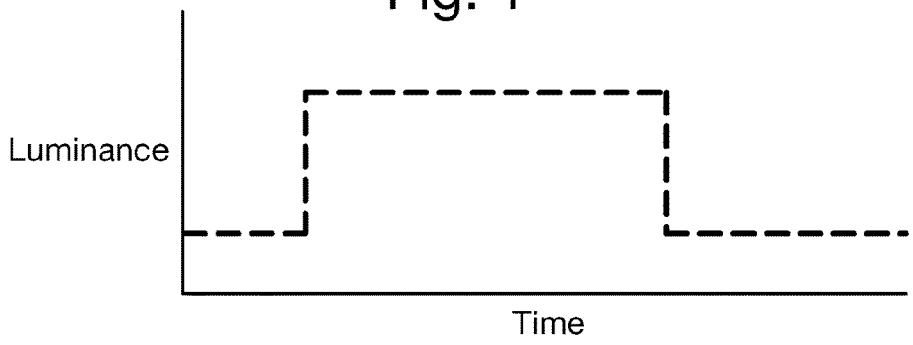
FIG. 1 schematically illustrates a graph showing the idealised luminous output of an LED as it transitions from an "off" state to an "on" state a back to "off"
Figure 2:
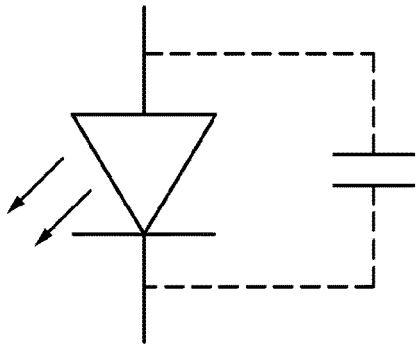
FIG. 2 schematically illustrates the junction capacitance of an LED in terms of its equivalent circuit component part.
Figure 3:
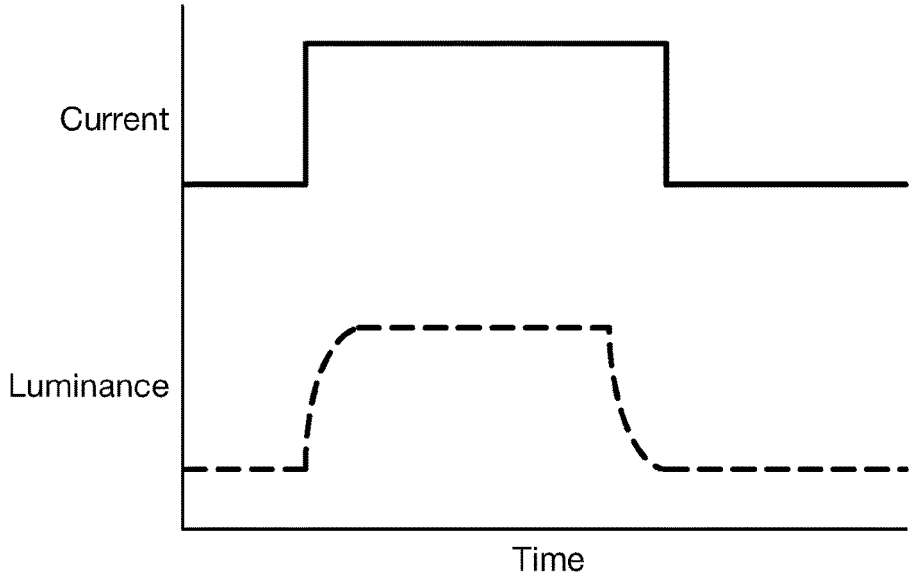
FIG. 3 schematically illustrates a graph showing the time development of a drive current input to an LED and the resulting luminous output of the LED having a junction capacitance, as it transitions from an "off" state to an "on" state a back to "off"

In the drawings, like items are assigned like reference symbols.

Figure 4:
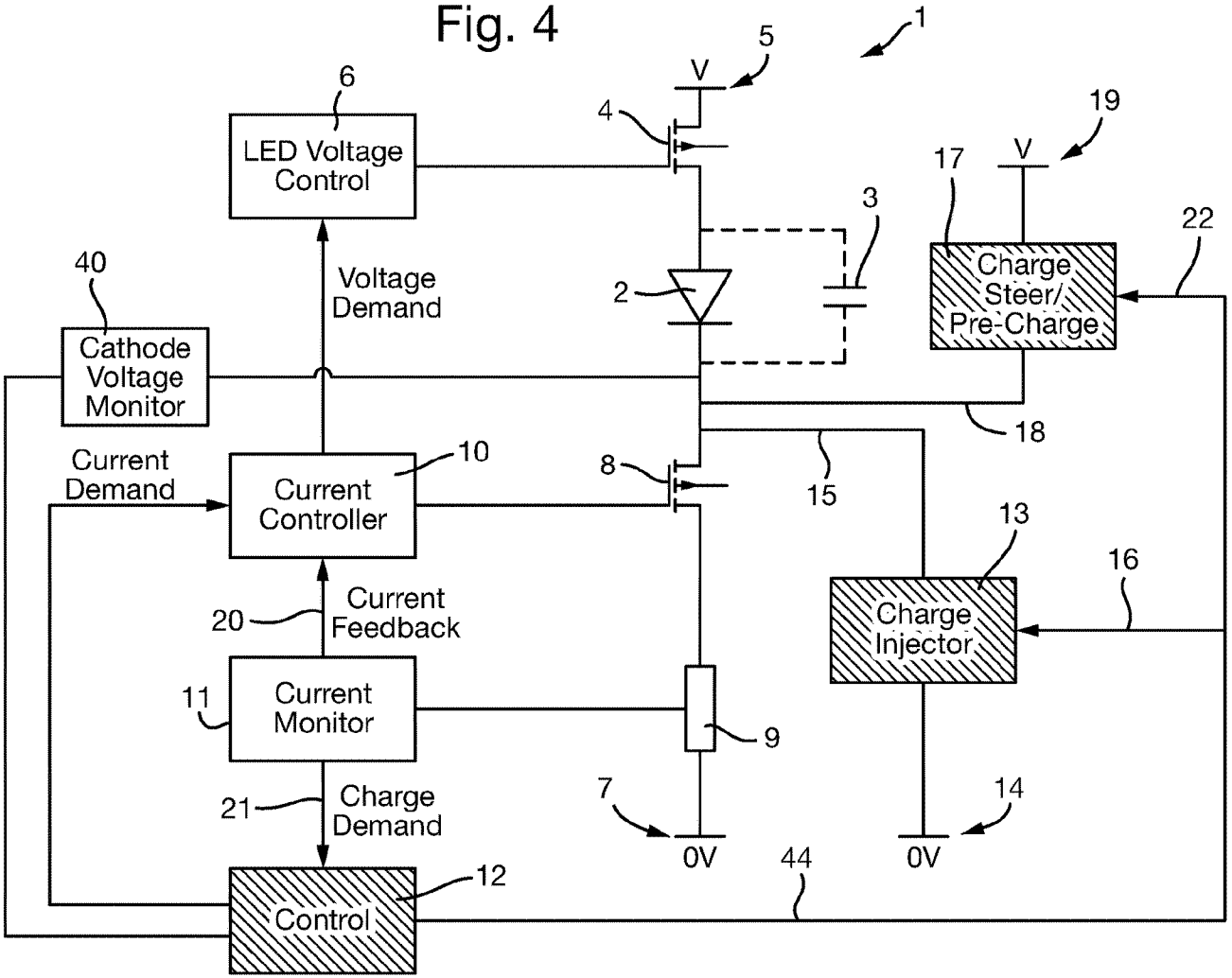
FIG. 4 illustrates a driver circuit for an LED according to an embodiment of the invention.

Referring to FIG. 4, a driver circuit 1, for driving an LED in a display, is arranged to switch the LED between a non-luminous (off) state and a luminous (on) state. The driver circuit includes an LED 2 possessing a junction capacitance represented in FIG. 1 by a capacitor 3 equivalent circuit component, which is electrically connected in parallel to both the anode and the cathode of the LED.

The anode of the LED is connected to a supply voltage source 5 (at voltage V, relative to ground) via a switching transistor 4 (a FET in this case) which controllably opens and closes (connects and disconnects) the electrical communication between the cathode of the LED and the supply voltage source 5. The gate terminal of the transistor is electrically connected to an LED voltage control unit 6, and the drain and source terminals of the transistor are electrically connected to the supply voltage source 5 and the anode of the LED, respectively. The voltage control unit 6 is arranged to control the conductivity of the switching transistor 4 according to a control voltage applied by it to the gate terminal thereby to electrically connect/disconnect the anode of the LED to the supply voltage source 5.

Similarly, the cathode of the LED is connected to a current control transistor 8 (a FET in this case) connected in series with a current sensing resistor 9 along a current flow path terminating at an electrically grounded terminal 7 (0 volts). The drain and source terminals of the current control transistor are connected to the cathode of the LED and the current sensing resistor 9, respectively. The gate of the transistor is connected to a drive current control unit 10 which is arranged to apply a voltage to the gate terminal which us below the threshold voltage of the transistor 8 for operating the transistor in the linear/Ohmic regime whereby the conductivity (drain current) of the transistor is variable according to the drain-to-source voltage drop across the transistor (i.e. in the manner of a variable resistor).

When controlled by the drive current control unit to be conductive, the current control transistor 8 permits current to flow from the cathode of the LED 2 along the current flow path to the grounded terminal 7 via the current sensing resistor 9. In doing so, a voltage is dropped across the current sensing resistor and this voltage is sensed by a current monitor unit 11 which comprises a voltage monitor, such as is readily available in the art, for this purpose. The detected voltage signal value ($V_{detected}$) is converted by the current monitor 11 into a detected current signal value ($I_{detected}$) by virtue of Ohms law ($I_{detected}=V_{detected}/R$) according to the value (R) of the resistance of the sensing resistor 9. In this way, the current minotor is able to detect simply the absence of any current flow when the LED is "off", and also to provide a value of any drive current present in the current flow path when the LED is "on".

When the current monitor detects a transition from the "off" state (i.e. no current detected) to the "on" state (i.e. drive current detected) it issues a "charge demand" signal 21 to a control unit 12 operatively connected to it. Furthermore, the value of the detected current is sent as a "current feedback" signal 20 to the drive current control unit 10 by the current monitor unit 11. The drive current control unit is arranged to compare the received detected current value to a "set-point" current value ($I_{SP}$) and to vary the value of the voltage applied to the gate of the current control transistor 8 to increase or decrease the conductivity of the transistor as necessary to cause the value of the detected current to approach the set-point current value. Thus, a feed-back loop is formed which allows the current flowing through the current flow path to be maintained at a desired, constant value.

The control unit 12 is arranged to respond to a "charge demand" signal 21 from the current monitor by issuing a charge injection signal 16 to a charge injector unit 13, via a control signal bus 44. The charge injector unit is responsive to the charge injection signal to input a controlled quantity of electrical charge into the LED so as to charge-up the junction capacitance 3 of the LED. To achieve this, the charge injector unit is electrically connected to the cathode of the LED directly (i.e. independently of the current control transistor 8) via a charge injection path 15. The charge injector unit 13 described here is the same as the charge injector unit 13 illustrated in more detail with reference to FIG. 16 below. It comprises a current source 45 (see FIG. 6) which is itself controllably connectable to the cathode of the LED via the charge injection path using a high-speed switch 46. The high-speed switch is responsive to the charge injection signal 16 to switch from an open state to a closed state thereby to place the current source in electrical connection with the cathode of the LED to allow charge to flow from the former to the latter.

The consequence of the injection of such charge at the instant a dive current is detected, is that the drive current value is somewhat boosted initially by an amount sufficient to compensate for current losses that would otherwise occur due to the charging-up of the junction capacitance of the LED in the initial phases of the "turn-on" of the LED. This current boost is shown schematically as additional current peak 30 in FIG. 5, and the consequential luminosity of the LED is substantially constant at and subsequent to the "turn-on". The drive current is maintained at a substantially constant value subsequently, during the luminous period of the LED, by action of the current feed-back loop (signal 20) described above.

Figure 6:
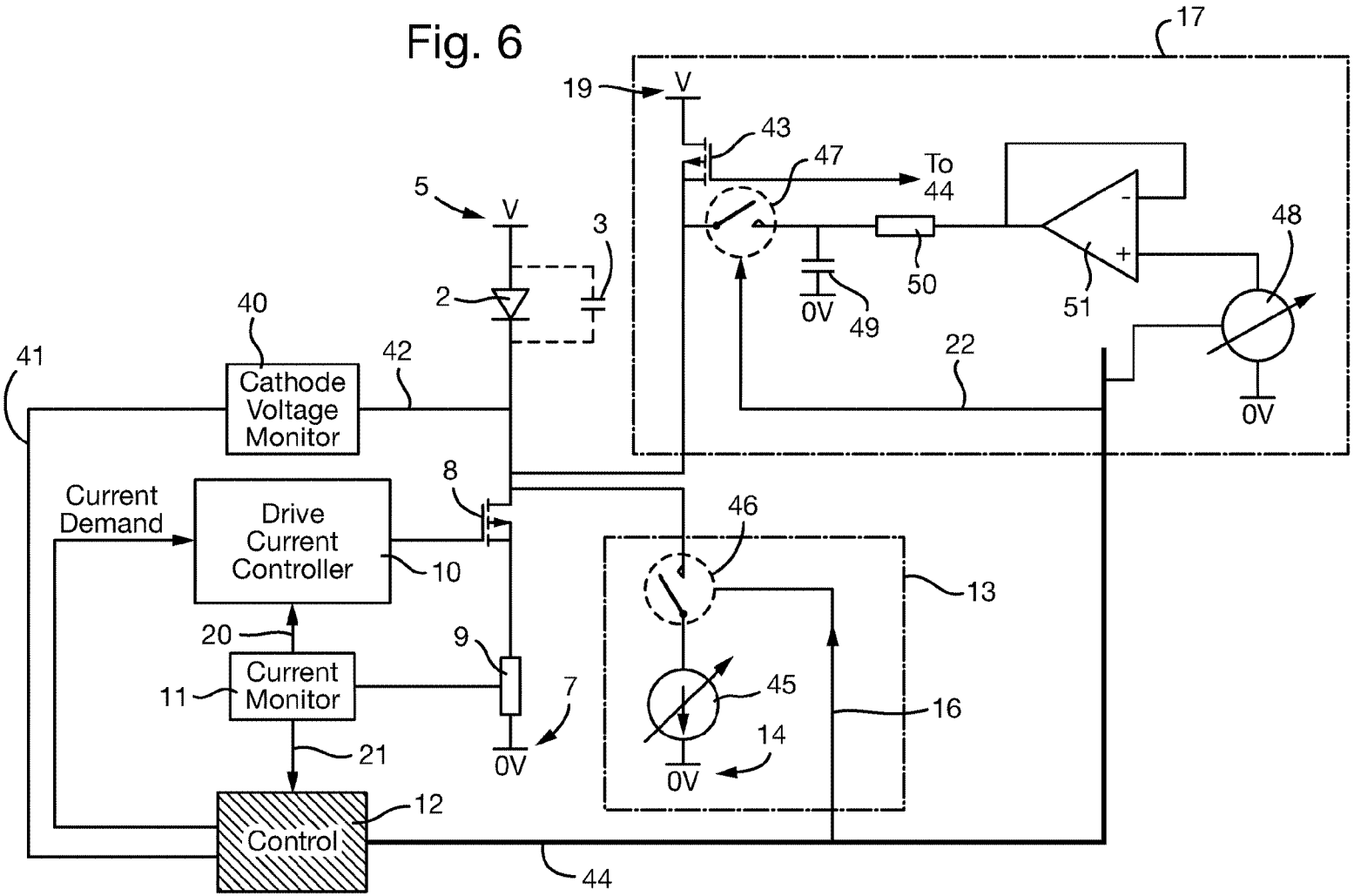
FIG. 6 illustrates a driver circuit for an LED according to an embodiment of the invention.

The quantity of charge injected into the cathode of the LED is controlled by controlling the current source (item 45; FIG. 6) to provide substantially constant current during the interval of time (at) that it is electrically connected to the LED cathode by the high-speed switch 46. This causes an electrical current of predetermined size to flow to the LED for an interval of time ($\Delta t$) of predetermined duration thereby to input into the LED a predetermined quantity of electrical charge (Q) according to the product of the current ($I_{inject}$) and duration of time ($\Delta t$) it flows. The duration is preferably less than 1 (one)(m second, such as about 500 ns.

Figure 5:
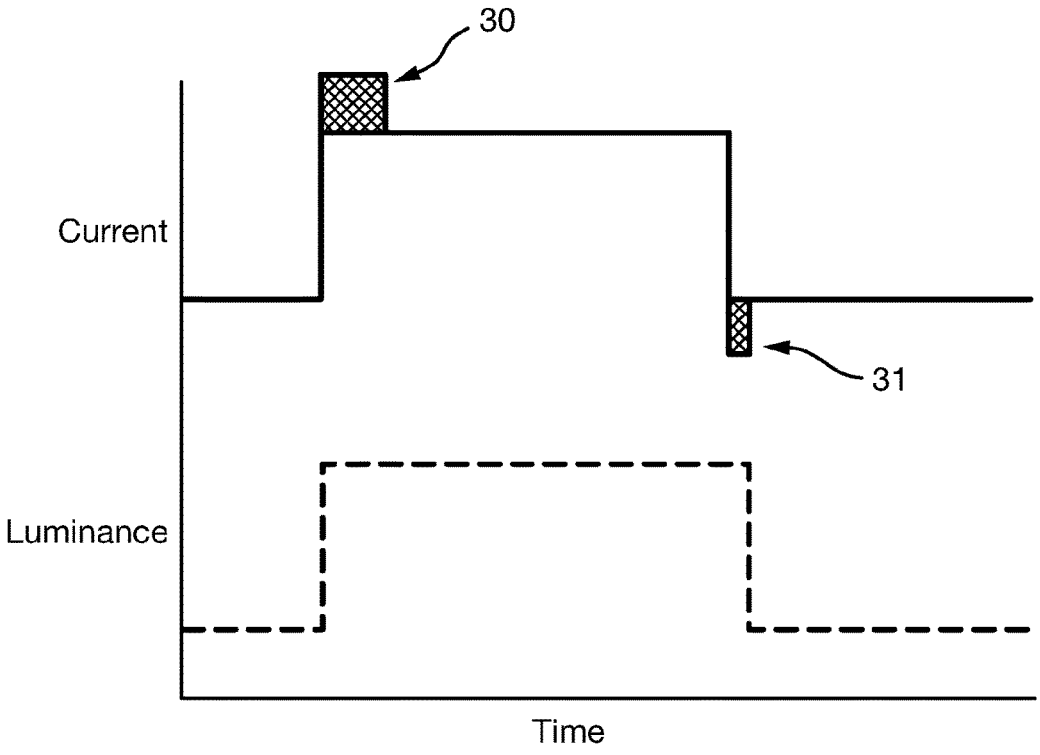
FIG. 5 schematically illustrates a graph showing the time development of a drive current input to an LED and the resulting luminous output of the LED having a junction capacitance, as it transitions from an "off" state to an "on" state a back to "off", when driven according to a drive circuit of an embodiment of the invention.

The quantity of electrical charge to be injected may be determined according to the product of the value of the forward threshold voltage of the LED, which is known, and the value of its junction capacitance. More generally, when the LED has a non-zero sub-threshold voltage across it (which may be advantageous, as described herein), then the quantity of charge to be injected may be determined according to the product of the value of: the difference between the forward threshold voltage of the LED and the sub-threshold voltage, which is known, and the value of its junction capacitance. In particular, it has been found that the following steps are effective in actively and contemporaneously calculating the value of the junction capacitance (C) of the LED in order to calculate the appropriate value of charge to inject into it to fully charge it when the LED is switched on, and to generate a control signal to the charge injector unit to implement that. The method is as follows:

(1) Discharge any existing stored charge in the junction capacitance (C) of the LED. This may be done by temporarily arranging that no electrical potential is dropped across the LED. For example, the switch 43 within the pre-charge unit 17 (FIG. 4, FIG. 6) may be switched to the "closed" state to connect voltage source 19 (V volts) to the cathode of the LED. This renders the potential difference between the LED electrodes zero. The switch 43 within the pre-charge unit 17 (FIG. 4, FIG. 6) may then be switched to the "open" state to disconnect voltage source 19 (V volts) from the cathode of the LED. This ensures that the potential difference across the LED is substantially 0 (zero) volts. Opening the switch (43) floats the cathode of the LED so it will maintain no potential difference across the LED. Thus, after the switch is opened the cathode will remain the voltage level of voltage source 19. The step (below) of monitoring a change in voltage (dv), and consequently this is a falling voltage. The control unit 12 is arranged to implement each of these switching operations via respective control signals sent via the control signal bus 44; then, (2) Draw a substantially constant current (I) from the LED to begin re-charging the junction capacitance. This is preferably done after a non-zero sub-threshold voltage has bee re-applied across the LED. The constancy of the current may be controlled by the current control unit 10 in the manner described above. The current control unit is arranged to be controlled by the control unit 12 in this regard via the "Current Demand" control signal line;

(3) Measure the change (e.g. fall) of the voltage (dV) over a time period (dt) across the LED as the junction capacitance charges up. This voltage may monitored by the cathode voltage monitor unit 40 which is arranged to monitor the voltage at the cathode of the LED and to input the result to the control unit 12. The control unit or a cathode voltage monitor 40 may be arranged to determine or calculate the value of the measured voltage change (dV) that has occurred after a given time interval (dt);

(4) Calculate the value of the junction capacitance as: $C=I(dt/dV)$. This calculation may be performed by the control unit 12. The calculation may be done by simply calculating the ratio of the measured voltage change (e.g. fall) (dV) that has occurred after a time interval dt, and multiplying the result with the measured current value (I). For example, an I=100 μA current applied over dt=100 μs of time during which a dV=1v voltage change occurs at the LED cathode, corresponds to a junction capacitance of $100\times100\times10^{-12}/1=10nF$;

(5) Inject into the LED a substantially fixed current ($I_{Inject}$) for a time interval defined as: $\Delta t=C(V_{Th}-V_{pc})/I_{Inject}$, so as to fully charge the junction capacitance source of the LED. Here, $V_{Th}$ is the forward threshold voltage of the LED and $V_{pc}$ is any pre-existing ('pre-charge') voltage across the LED which may be pre-set to a non-zero, sub-threshold value. The current control unit 10 may preferably be arranged to calculate time interval Δt and to issue a control signal 16 to the charge injector unit 13 (FIG. 4; FIG. 6 in more detail) to implement the charge injection by closing the high-speed switch 46 for a time interval Δt thereby to connect the constant current source 45 to the cathode of the LED to inject charge into the junction capacitance accordingly. When mentioning just the voltage at the cathode in the present example, the voltage is preferably falling in value. However, when mentioning the voltage across the LED the voltage is preferably increasing or ramping in value. In this way, by linearly increasing ("ramping") over time the voltage across the LED, a fixed junction capacitance will produce a constant current drawn from the LED. Thus, by measuring the current drawn from the LED while ramping the voltage applied to it, it has been found that one may determine the capacitance over the bias voltage across the LED and determine the amount of charge required to inject in to the LED by the charge injector 13. The linearly-ramped voltage applied across the LED is preferably limited to below the threshold voltage of the LED to ensure that the LED remains non-conducting so that substantially all current that is drawn from the LED is drawn from the junction capacitance within it. This is due to the charge being discharged from the LED junction capacitance, and generating a current as a result. The result of this carefully measured application of a current boost to the LED is shown schematically as the additional current peak 30 in FIG. 5, and the consequential luminosity of the LED is substantially constant at and subsequent to the "turn-on" of the LED. In FIG. 5, the end of the current pulse has a dip 31. This is due to the current being discharged from the LED junction capacitance. In order to achieve a rapid transition in output luminosity of the LED from the "on" state to the "off" state, a charge steer unit 17 is electrically connected to the cathode of the LED directly (i.e. not via the current control transistor 8). The charge steer unit is arranged to apply a voltage to the cathode of the LED which is sufficient to reduce the potential difference between the cathode and anode of the LED to be below the LED's threshold voltage. Consequently, the LED responds by becoming non-luminous, and allows it to rapidly discharge as shown in FIG. 5 (item 31).

The voltage applied by the charge steer unit may be equal in value to the voltage (V) supplied by the voltage source 5 connected to the anode of the LED. When applied to the LED cathode by the charge steer unit 17, the potential difference across the LED becomes substantially zero, and the LED non-luminous. This may implement step (1) of the pre-charge current injection methodology described above. Alternatively, or subsequently, the voltage applied to the LED cathode by the charge-steer unit 17 may be less than the value (V) of the source voltage 5 applied to the LED anode, but be sufficiently large that the potential difference between the LED electrodes is below the LED threshold voltage. This may also form a part of step (2) of the pre-charge current injection methodology described above.

For example, as shown in FIG. 4 and in more detail in FIG. 6, the charge-steer unit 17 may comprise a transistor switch 43, such as a FET, the source and drain terminals of which are electrically connected to a voltage supply 19 (voltage V) and to the LED cathode, respectively. The gate terminal of the switch 43 is connected to the signal bus line 44 for receiving control signals from the control unit 12. The control unit may be arranged to supply control signals to the switch 43 to operate the transistor in the Ohmic regime thereby providing a variable voltage signal to the LED cathode. Alternatively, as shown in FIG. 6, the charge-steer unit 17 may comprise a pre-charge capacitor 49 connected to the LED cathode via a high-speed switch 47 operable to open/close in response to a charge control signal 22 from the control unit 12, via the signal bus line 44. The closing of the high-speed switch 47 applies to the LED cathode the voltage stored in the pre-charge capacitor 49.

By switching the transistor 43 of the charge-steer unit 17 to a conductive state, one may remove any potential difference across the LED, or by switching the high-speed switch 47 to connect the pre-charge capacitor 49 to the LED cathode, one may change the potential difference across the LED to a pre-charged state.

During the "off" phase of the LED, it is held at a non-zero (sub-threshold) voltage which maintains the LED in the sub-luminous state but which is a finite voltage. This finite voltage is typically about 1 (one) volt in value. This means that the FET is maintained in a "ready to go" state which is non-luminous, so effectively "off" yet is close to the threshold voltage required to achieve the luminous "on" state. Consequently, the voltage across the LED is not required to range as greatly as from zero volts to the threshold voltage in order to transition from the non-luminous state to the luminous state. This assists in achieving a rapid switch-on time.

This is achieved via the charge-steer unit 17 which comprises a voltage source connected to the pre-charge capacitor 49 for pre-charging the capacitor to a desired voltage. The high-speed switch unit 47 is arranged to controllably connect/disconnect the pre-charge capacitor to the cathode of the LED so as to achieve a desired sub-threshold potential difference between the anode and the cathode of the LED when it is in the non-conducting, non-luminous "off" state. The charge-steer unit is arranged to perform this switching, and voltage application, in response to a voltage control signal 22 from the control unit 12 which is issued via the control signal bus 44 when the LED is to be maintained in the sub-luminous "off" state. The charge-steer unit is responsive to a control signal from the control unit to open the high-speed switch 47 therein to disconnect the pre-charge capacitor 49 from the cathode of the LED when the LED is to enter the luminous "on" state.

To this end, the control unit 12 is arranged to issue a signal (22) to open the switch in the charge-steer unit substantially simultaneously with a control signal to close the high-speed switch 46 in the charge injector unit 13, such that injection of charge into the LED may occur when the pre-charge voltage applied to the LED by the pre-charge capacitor 49, is replaced by the ground (0v)_voltage 7 to raise the potential difference between the cathode and anode of the LED to above-threshold levels. A pre-charge variable voltage source 48 is provided within the pre-charge/charge-steer unit 17 which is in electrical communication with the pre-charge capacitor 49 via a stabilising fee-back amplifier unit (50, 51). The voltage supplied by the pre-charge variable voltage source is controlled by the control unit 12 via control signals issued to the pre-charge variable voltage source 48 along the control signal bus 44 connecting the two.

The invention claimed is:

1. A driver circuit for an LED display for switching a light-emitting diode (LED) between a non-luminous state and a luminous state for producing light for a display, the driver circuit comprising:

an LED;

a drive current controller arranged to selectively open and close a drive current flow path through the LED thereby selectively to switch the LED between a non-luminous state and a luminous state;

a current monitoring unit arranged to monitor a current flowing through the drive current flow path to detect switching of the drive current flow path between opened and closed, and to generate a charge demand signal representing the switching of the drive current flow path;

a charge injector unit for inputting charge into the LED to store said charge within the LED via a junction capacitance of the LED; and a charge injection control unit arranged to control the charge injector unit to input said charge into the LED upon the charge demand signal representing the opening of the drive current flow path.

2. The driver circuit according to claim 1 comprising a switching transistor and in which the drive current controller includes a voltage controller arranged to control the switching transistor to selectively electrically connect and disconnect the LED to a drive voltage source.

3. The driver circuit according to claim 1 in which the charge injector unit is electrically connected to a cathode of the LED.

4. The driver circuit according to claim 1 in which the charge injector unit is arranged to cause an electrical current of predetermined size to flow to the LED for an interval of time of predetermined duration thereby to input into the LED a predetermined quantity of electrical charge according to the product of said size and said duration.

5. The driver circuit according to claim 4 in which said duration is less than 1 (one) micro-second.

6. The driver circuit according to claim 1 in which the charge injector unit is arranged to input into the LED a predetermined quantity of electrical charge according to the value determined by the product of the value of a forward threshold voltage of the LED and the value of the junction capacitance.

7. The driver circuit according to claim 1 comprising a current control transistor electrically connected in series to the LED upon said current flow path, wherein the drive current controller is arranged to control the conductivity of the current control transistor to permit current along the drive current flow path.

8. The driver circuit according to claim 7 in which the drive current controller is arranged to control the conductivity of the transistor to maintain a substantially constant drive current in the drive current flow path when the current control transistor is conductive.

9. The driver circuit according to claim 8 including a current monitor unit arranged to monitor the value of electrical current flowing along the drive current flow path and to output to the drive current controller a current monitor signal indicative thereof, wherein the drive current controller is responsive to the current monitor signal to control the conductivity of the current control transistor so as to maintain said substantially constant drive current.

10. The driver circuit according to claim 1 including a charge steer unit arranged to apply a voltage to the LED to reduce a potential difference across the LED to a predetermined sub-threshold forward voltage to the LED which is less than a forward threshold voltage of the LED, wherein the charge injection control unit is further arranged to control the charge steer unit to apply said voltage to the LED concurrently with the closing of the drive current flow path.

11. The display comprising a driver circuit according to claim 1.

12. A method for driving a light-emitting diode (LED) to switch between a non-luminous state and a luminous state for producing light for a display, the method comprising:

selectively opening and closing a drive current flow path through the LED thereby selectively switching the LED between a non-luminous state and a luminous state;

monitoring a current flowing through the drive current flow path to detect switching of the drive current flow path between opened and closed, and generating a charge demand signal representing the switching of the drive current flow path;

inputting charge into the LED to store said charge within the LED via a junction capacitance of the LED; and controlling the charge injector unit to input said charge into the LED upon the charge demand signal representing the opening of the drive current flow path.

13. The method according to claim 12 wherein selectively opening and closing the drive current flow path includes selectively electrically connecting and disconnecting the LED to a drive voltage.

14. The method according to claim 12 in which the charge is input to a cathode of the LED.

15. The method according to claim 12 including causing an electrical current of predetermined size to flow to the LED for an interval of time of predetermined duration thereby to input into the LED a predetermined quantity of electrical charge according to the product of said size and said duration.

16. The method according to claim 15 in which said duration is less than 1 (one) micro-second.

17. The method according to claim 12 including inputting into the LED a predetermined quantity of electrical charge according to the value determined by the product of the value of a forward threshold voltage of the LED and the value of the junction capacitance.

18. The method according to claim 12 including providing a current control transistor electrically connected in series to the LED upon said current flow path, wherein the switching the drive current control path includes controlling the conductivity of the current control transistor to permit current along the drive current flow path.

19. The method to claim 18 including controlling the conductivity of the transistor to maintain a substantially constant drive current in the drive current flow path when the current control transistor is conductive.

20. The method according to claim 19 including monitoring the value of electrical current flowing along the drive current flow path and controlling the conductivity of the current control transistor so as to maintain said substantially constant drive current.

21. The method according to claim 12 including applying a voltage to the LED to reduce a potential difference across the LED to a predetermined sub-threshold forward voltage to the LED which is less than a forward threshold voltage of the LED, and applying said voltage to the LED concurrently with the closing of the drive current flow path.

* * * * *